US011752612B2

(12) United States Patent
Moore et al.

(10) Patent No.: US 11,752,612 B2
(45) Date of Patent: Sep. 12, 2023

(54) DUST SUPPRESSION SYSTEM FOR HAMMERS

(71) Applicant: Caterpillar Inc., Peoria, IL (US)

(72) Inventors: Cody Moore, Lorena, TX (US); Akshay D. Mate, Pune (IN); Hariom Kumar Gupta, Chennai (IN); Dhanunjaya D. Reddy, Chennai (IN); Chetan Vilas Dahiwal, Chennai (IN)

(73) Assignee: Caterpillar Inc., Peoria, IL (US)

( * ) Notice: Subject to any disclaimer, the term of this patent is extended or adjusted under 35 U.S.C. 154(b) by 87 days.

(21) Appl. No.: 17/101,505

(22) Filed: Nov. 23, 2020

(65) Prior Publication Data

US 2022/0161408 A1 May 26, 2022

(51) Int. Cl.
*B25D 17/22* (2006.01)
*E02F 3/96* (2006.01)

(52) U.S. Cl.
CPC ..... *B25D 17/22* (2013.01); *E02F 3/966* (2013.01); *B25D 2217/0057* (2013.01)

(58) Field of Classification Search
CPC .. B25D 17/22; B25D 2217/0057; E02F 3/966
USPC ..... 173/78
See application file for complete search history.

(56) References Cited

U.S. PATENT DOCUMENTS 819,755 A * 5/1906 Hellman ..... E21B 3/02 173/133
1,293,081 A * 2/1919 Gilman ..... E21B 21/01 173/133
2,784,701 A * 3/1957 O'Farrell ..... E21B 21/14 173/63
3,398,609 A * 8/1968 Schott ..... B23Q 11/10 239/289
3,547,350 A * 12/1970 Marcoux ..... B23Q 11/1084 239/308
4,213,354 A * 7/1980 Dahinden ..... B23Q 11/1015 82/900

(Continued)

FOREIGN PATENT DOCUMENTS

CN 102261246 A 11/2011
DE 4423166 A1 1/1996

(Continued)

OTHER PUBLICATIONS

Michael R. Cooper, et al., "Hydraulic Impact Hammers with Wet Dust Suppression", Construction Solutions, www.cpwrconstructionsolutions.org, Nov. 23, 2020, CPWR—The Center for Construction.

(Continued)

*Primary Examiner* — Thomas M Wittenschlaeger
*Assistant Examiner* — David G Shutty

(57) ABSTRACT

A dust suppression system for a demolition hammer is disclosed. The dust suppression system may have a water hose routed within a power cell of the demolition hammer, and a connector channel internal of the walls of a front head of the demolition hammer. The water hose may be utilized to deliver water from outside of the demolition hammer to a connection valve on a top end of the front head, and the internal connector channel may deliver water from the connection valve to one or more nozzles located at a bottom end of the front head.

2 Claims, 8 Drawing Sheets

(56) References Cited

U.S. PATENT DOCUMENTS

| | | | | | |
|---|---|---|---|---|---|
| 4,382,475 | A * | 5/1983 | Suzuki | E02D 11/00 | 173/206 |
| 4,736,805 | A | 4/1988 | Shook et al. | | |
| 4,854,393 | A * | 8/1989 | Palet | B25D 9/14 | 408/61 |
| 5,327,979 | A * | 7/1994 | Du | E21B 21/14 | 173/199 |
| 5,944,263 | A * | 8/1999 | Lucco | B05B 15/654 | 239/289 |
| 6,227,307 | B1 * | 5/2001 | Lee | B25D 17/11 | 173/78 |
| 6,705,805 | B2 * | 3/2004 | Lagerberg | B23Q 11/1084 | 82/1.11 |
| 7,785,046 | B2 * | 8/2010 | Beckington | B23B 31/02 | 279/20 |
| 8,784,022 | B2 * | 7/2014 | Leishman | B23Q 11/10 | 409/136 |
| 9,138,847 | B2 * | 9/2015 | Yeh | B23Q 11/1015 | |
| 10,603,751 | B2 * | 3/2020 | Dcunha | B23Q 11/0071 | |
| 11,103,988 | B2 * | 8/2021 | Scigliano | B25D 17/22 | |
| 2013/0189060 | A1 * | 7/2013 | Lamonte | E02F 3/8825 | 414/507 |
| 2019/0309498 | A1 | 10/2019 | Grzybowski | | |
| 2019/0381645 | A1 * | 12/2019 | Beckhusen | B25D 9/04 | |

FOREIGN PATENT DOCUMENTS

| | | | | | |
|---|---|---|---|---|---|
| DE | 202013102616 | U1 | | 9/2013 | |
| EP | 0695602 | | * | 2/1996 | B23Q 11/08 |
| EP | 0695602 | B1 | | 2/2000 | |
| GB | 647023 | A | * | 12/1950 | |
| GB | 647023 | A | | 12/1950 | |
| WO | 9605945 | A1 | | 2/1996 | |
| WO | 9605945 | W | | 2/1996 | |

OTHER PUBLICATIONS

Written Opinion and International Search Report for Int'l. Patent Appln. No. PCT/US2021/059330, dated Mar. 2, 2022 (11 pgs).

* cited by examiner

DUST SUPPRESSION SYSTEM FOR HAMMERS

TECHNICAL FIELD

The present disclosure generally relates to demolition hammers and, more particularly, relates to a dust suppression system for demolition hammers.

BACKGROUND

Demolition hammers are widely used on work sites to break up or demolish large hard objects, such as, rocks, concrete, asphalt, frozen ground, etc., before such objects can be moved away. Demolition hammers can be mounted, via a mounting bracket, to work machines like back hoes or excavators. In operation, high pressure fluid enters the hammer through a valve body which is further pressurized inside the hydraulic system of the hammer. This high-pressure fluid accelerates the piston which hits the work tool. When the tool is in contact with the hard object a shock wave is created, and impact energy is transferred onto the hard object, causing the hard object to break. When the hard object breaks, a large and undesirable amount of dust may be created.

PCT Pub. No.: WO96/05945 describes a hammer for binding dust spreading during breaking work from the material to be broken to the surroundings. The hammer has a conduit located inside of a casing of the hammer to spray a dust binding agent onto the target to be broken. Furthermore, a nozzle at the bottom end of the casing is attached to the conduit in order to direct the spray of the dust binding agent at the target to be broken by a tool of the hammer.

While effective, there remains a need for improved dust suppression system designs for demolition hammers used in high wear applications, such as construction and mining.

SUMMARY

In accordance with one aspect of the present disclosure, a dust suppression system for a demolition hammer is disclosed. The dust suppression system may have a water hose routed within a power cell of the demolition hammer, and a connector channel internal of the walls of a front head of the demolition hammer. The water hose may be utilized to deliver water from outside of the demolition hammer to a connection valve on a top end of the front head, and the internal connector channel may deliver water from the connection valve to one or more nozzles located at a bottom end of the front head.

In accordance with another aspect of the present disclosure, a demolition hammer is disclosed. The demolition hammer may include a housing that has a bottom wear plate at the distal end of the housing and a power cell enclosed in the housing. The power cell has a front head, cylinder, piston, tie rods, and a valve body. The demolition hammer further includes a work tool and a dust suppression system. The dust suppression system may have a water hose routed within a power cell of the demolition hammer, and a connector channel internal of the walls of a front head of the demolition hammer. The water hose may be utilized to deliver water from outside of the demolition hammer to a connection valve on a top end of the front head, and the internal connector channel may deliver water from the connection valve to one or more nozzles located at a bottom end of the front head.

In accordance with another aspect of the present disclosure, a work machine is disclosed. The work machine may have a frame, a boom having an arm, and a demolition hammer connect to the arm. The demolition hammer may include a housing that has a bottom wear plate at the distal end of the housing and a power cell enclosed in the housing. The power cell has a front head, cylinder, piston, tie rods, and a valve body. The demolition hammer further includes a work tool and a dust suppression system. The dust suppression system may have a water hose routed within of a power cell of the demolition hammer, and a connector channel internal of the walls of a front head of the demolition hammer. The water hose may be utilized to deliver water from outside of the demolition hammer to a connection valve on a top end of the front head, and the internal connector channel may deliver water from the connection valve to one or more nozzles located at a bottom end of the front head.

These and other aspects and features of the present disclosure will be more readily understood when read in conjunction with the accompanying drawings.

DETAILED DESCRIPTION

Figure 1:
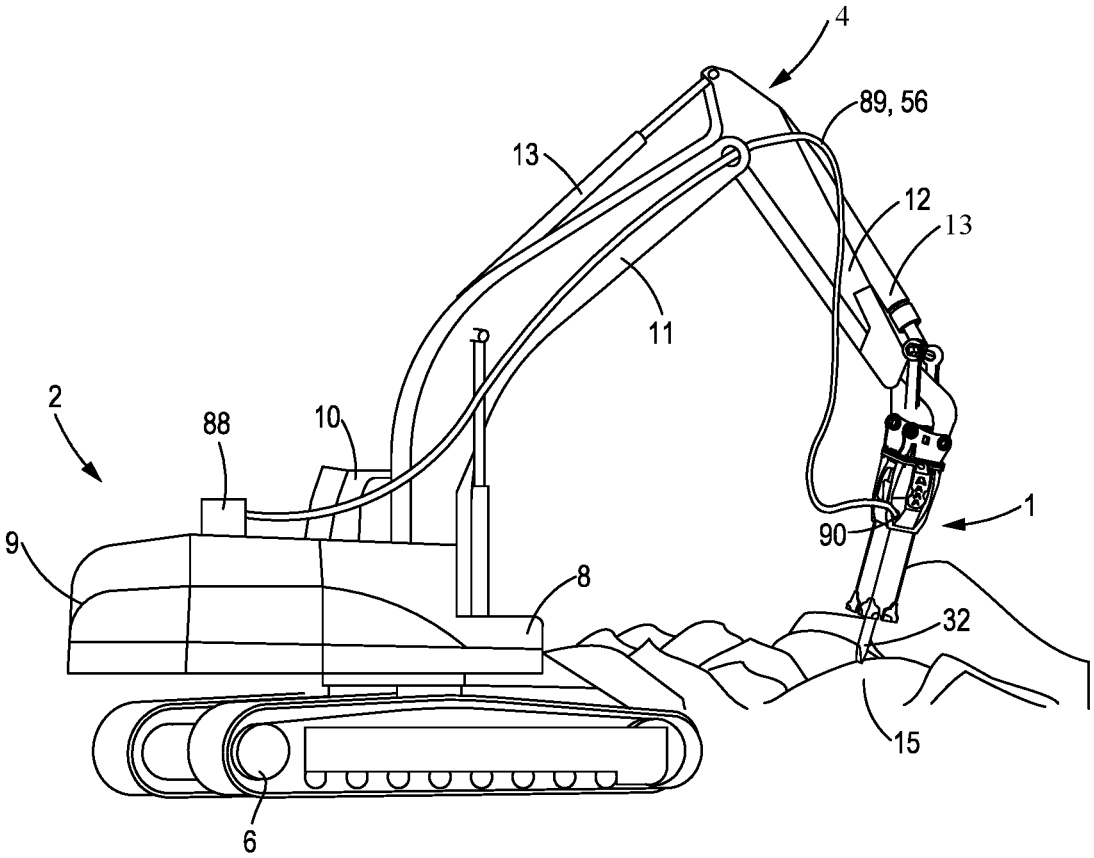
FIG. 1 is a diagrammatic illustration of a machine having a demolition hammer.
Figure 2:
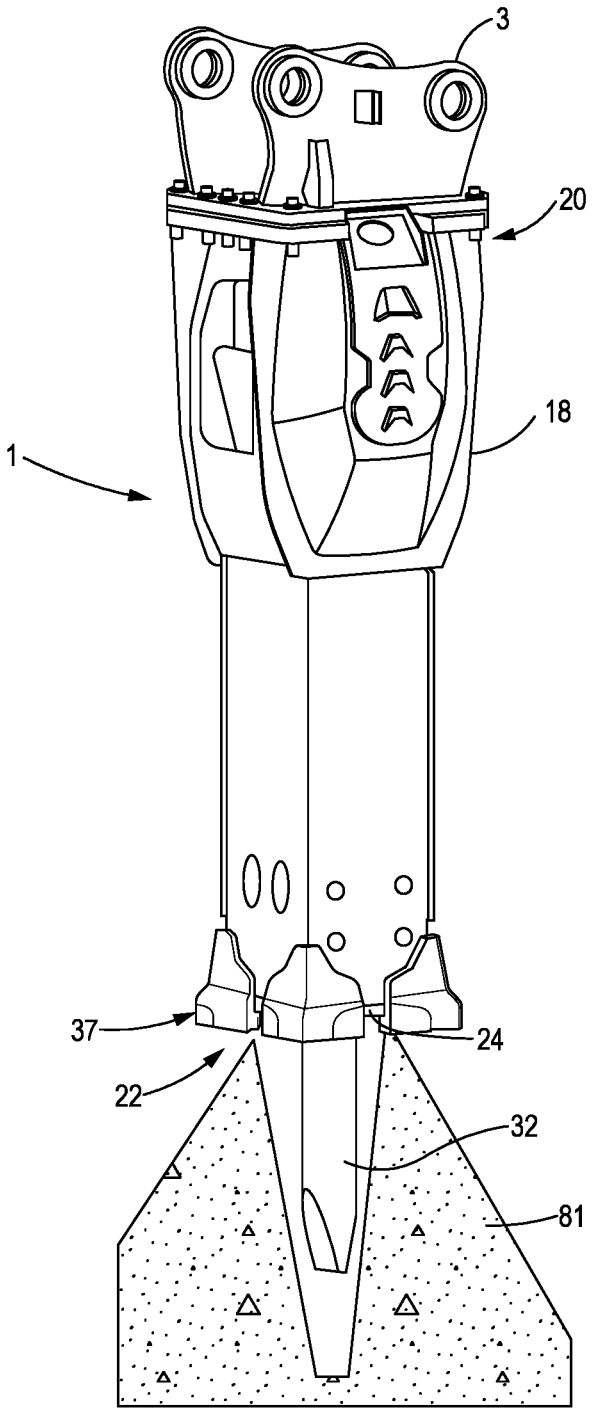
FIG. 2 is a perspective view of an exemplary demolition hammer, in accordance with the present disclosure.
Figure 3:
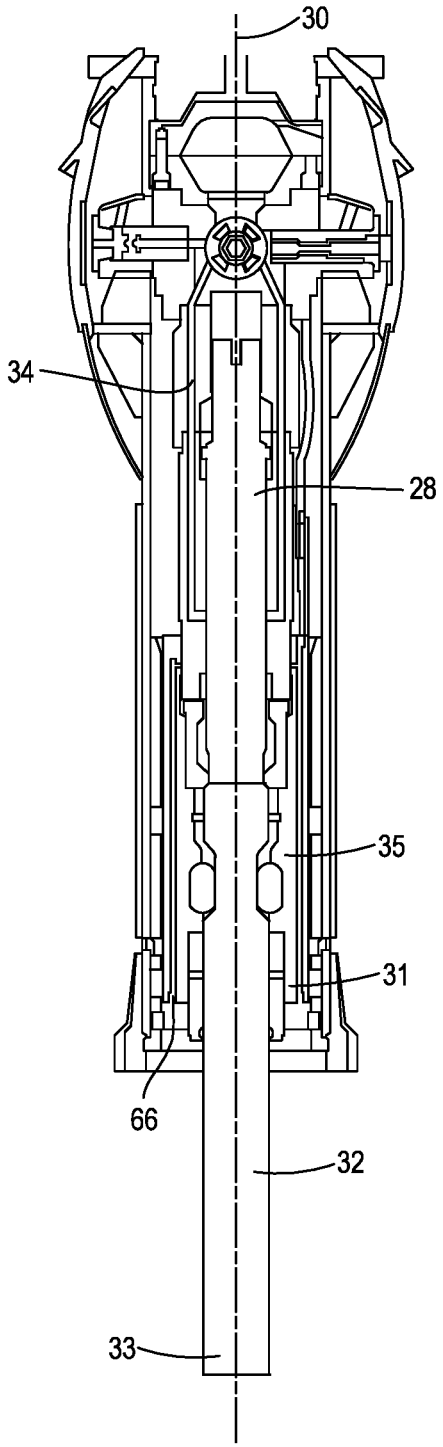
FIG. 3 is a partial cross-sectional view of the demolition hammer of FIG. 2, in accordance with the present disclosure.

Referring to FIG. 1, a demolition hammer 1 is attached to a work machine 2 by a mounting bracket 3 (shown in FIG. 3). The work machine 2 may embody a fixed or mobile machine that performs some type of operation associated with an industry such as mining, construction, farming, transportation, or any other industry known in the art. For example, work machine 2 may be an earth moving machine such as a backhoe, an excavator, a dozer, a loader, a motor grader, or any other earth moving machine. Work machine 2 may include an implement system 4 configured to move the demolition hammer 1, a drive system 6 for propelling the work machine 2, a frame 8, a power source 9 that provides power to the implement system 4 and the drive system 6, and an operator station 10 for operator control of the implement system 4 and the drive system 6.

Implement system 4 may include a boom 11 connected to an arm 12, or other linkage structures (not shown) acted on by fluid actuators 13 to move the demolition hammer 1. The implement system 4 may be complex, for example, including three or more degrees of freedom. The implement system 4 may carry the demolition hammer 1 for breaking a hard object (not shown) or ground surface 15.

Figure 4:
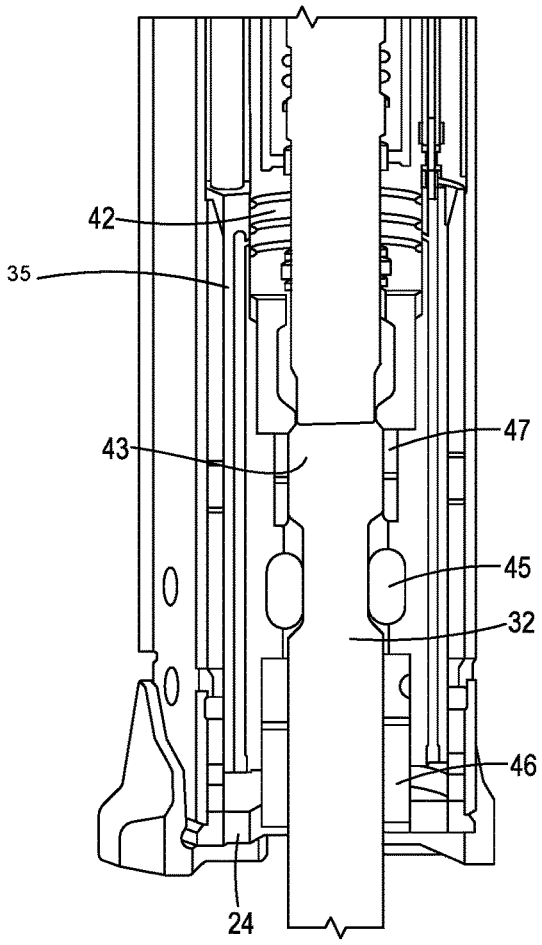
FIG. 4 is a partial cross-sectional view of a front head of the demolition FIG. 2, in accordance with the present disclosure.
Figure 5:
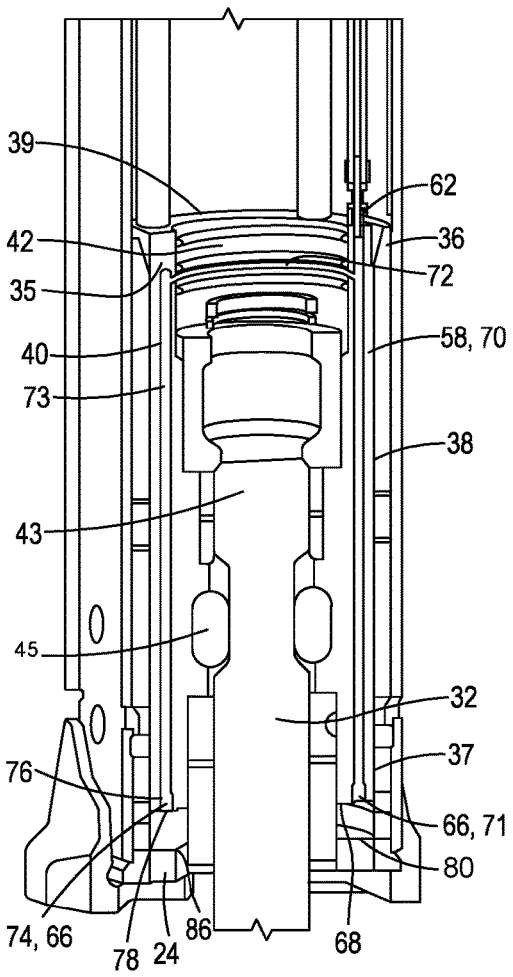
FIG. 5 is a partial cross-sectional view of the front head of the demolition hammer of FIG. 2 with the piston removed, in accordance with the present disclosure.
Figure 6:
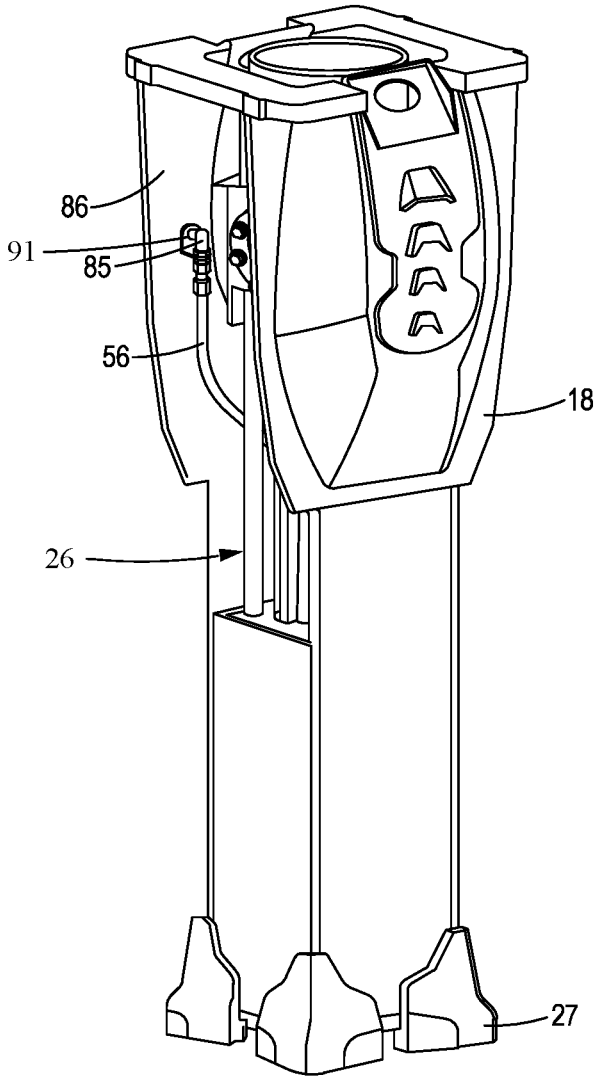
FIG. 6 is a perspective view of a power cell inside of a housing of the demolition hammer of FIG. 3
Figure 7:
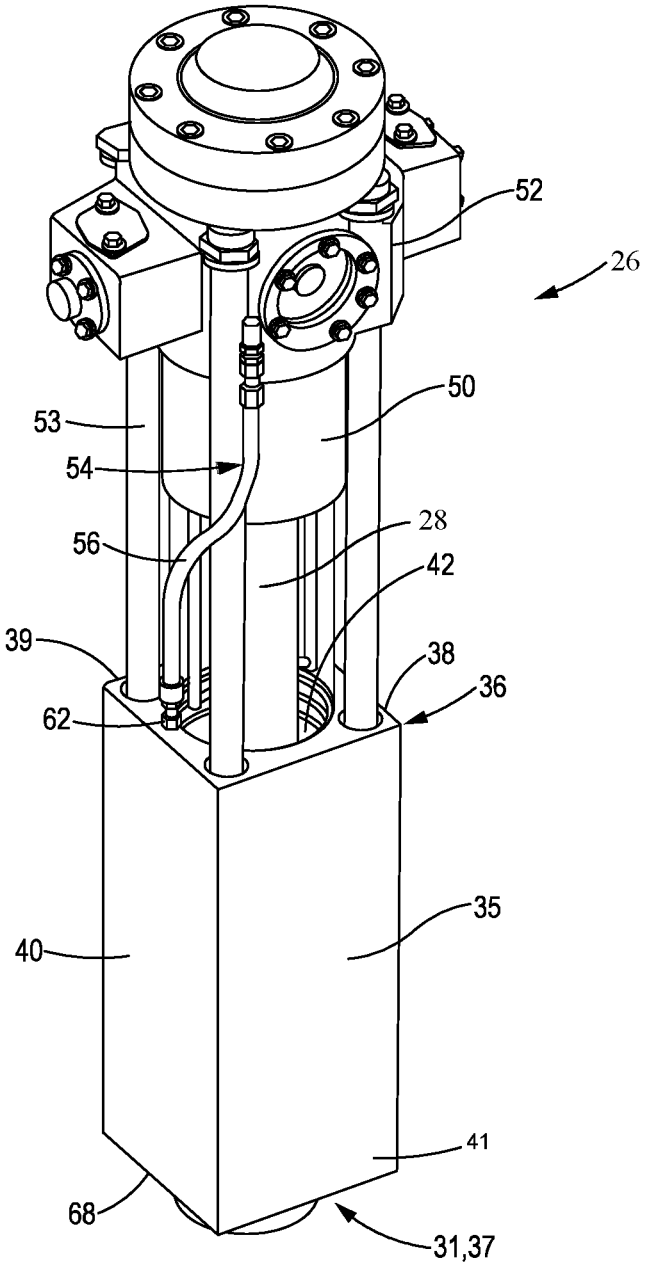
FIG. 7 is a perspective view of the power cell of the demolition hammer of FIG. 2, in accordance with the present disclosure.

Referring to FIGS. 2-7, the demolition hammer includes a hollow housing 18 having a proximal end 20 and a distal end 22. A bottom wear plate 24 defining one or more slots 25 (shown in FIG. 8), is attached to the distal end 22 of the housing 18. As best shown in FIGS. 6 and 7, a power cell 26 is supported inside the housing 18. In an exemplary embodiment, the power cell 26 is enclosed inside of the housing by one or more side buffers 27. The power cell 26 includes several internal components of the demolition hammer 1. As shown in FIG. 3, the power cell 26 provides an impact assembly that includes a piston 28. The piston 28 is operatively positioned within the power cell 26 to move along an axis 30. A distal portion 31 of the power cell 26 includes a work tool 32 that is operatively positioned to move along the axis 30.

Near the end of a work stroke, the piston 28 strikes the work tool 32. A distal portion 33 of the work tool 32 may be positioned to engage a hard object or the ground surface 15 (see FIG. 1). The impact of the piston 28 on the work tool 32 may cause a shock wave that fractures the hard object (e.g. rock) causing it to break apart.

The demolition hammer may be powered by any suitable means, such as pneumatically-powered or hydraulically-powered. For example, a hydraulic circuit 34 or pneumatic circuit (not shown) may provide pressurized fluid to drive the piston 28 toward the work tool 32 during the work stroke and to return the piston 28 during a return stroke. The hydraulic circuit 34 or pneumatic circuit is not described further, since it will be apparent to one skilled in the art that any suitable hydraulic or pneumatic systems may be used to prove pressurized fluid to the piston 28, such as the hydraulic arrangement described in U.S. Pat. No. 5,944,120.

The work tool 32 is retained within a front head 35 of the power cell 26. As best shown in FIG. 7, the front head has a proximal end 36 and a distal end 37, and in an exemplary embodiment, is rectangular in shape having a first, second, third, and fourth wall 38, 39, 40, 41. As shown in FIGS. 4-5, the front head 35 defines an aperture 42 for retaining the work tool 32 that extends through the center of the front head 35 from the proximal end 36 of the front head 35 through the distal end 37 of the front head 35. Further shown in FIGS. 4-5, a proximal portion 43 of the work tool 32 is retained within the front head 35 by a pair of pins 45 (e.g. tool retaining pins). The pins 45 allow the work tool 32 to move axially, but provide limits to how far the tool may extend or retract. The pins 45 may also absorb some of the impact load if the work tool 32 does not contact a hard object or ground surface 15 during the power stroke. In the depicted exemplary embodiment, the pins 45 have an oval cross-section with a height greater than a width, but in other embodiments, the pins may be shaped differently. Further, a lower bushing 46 and an upper busing 47 are positioned inside of the aperture 42 for guiding the work tool 32 during operation of the demolition hammer 1. As shown in FIG. 3, the distal portion 33 of the work tool 32 extends out of the aperture 42, through an opening 48 (shown in FIG. 8) of the bottom wear plate 24 and away from the distal end 37 of the front head 35.

As best shown in FIG. 7, the piston 28 is at least partially retained inside of a cylinder 50, and may be at least partially retained inside of the aperture 42. The cylinder 50 extends from a valve body 52 to the top of the front head 35, or in some exemplary embodiments, extends and is at least partially inserted in the aperture 42 at the proximal end 36 of the front head 35. The cylinder 50 supports the piston 28 as it is driven towards the work tool 32 (as shown in FIG. 3) during the work stroke and when the piston 28 is returned during a return stroke. The front head 35 is attached to the valve body 52 by one or more tie rods 53. The exemplary embodiment in FIG. 7 shows four tie rods attaching the valve body 52 to the front head 35.

When the work tool 32 contacts the hard object or the ground surface 15, a shock wave is created, and impact energy is transferred onto the hard object or ground surface 15, causing the contacted hard object to break and creating large amounts of dust. To minimize or suppress the amount of dust created, the demolition hammer 1 may utilize a dust suppression system 54. In an exemplary embodiment, the dust suppression system 54 includes a water house 56 routed within the power cell 26 of the demolition hammer 1, and a connector channel 58 within, or internally of, one or more walls of the first, second, third, and fourth walls 38, 39, 40, 41 of the front head 35. The water hose 56 is used to deliver water from outside of the demolition hammer to a connection valve 62 on a top end 64 of the front head 35, and the connector channel 58 is used to deliver water from the connection valve 62 to one or more nozzles 66 located at a bottom end 68 of the front head.

As best shown in FIG. 5, the connector channel 58 includes a first branch 70, extending from the proximal end 36 to the distal end 37 of the front head 35, and internally channeled through the first wall 38 of the front head 35. The first branch 70 connects the connection valve 62 to a first nozzle 71 of the one or more nozzles 66, allowing water to flow from the connection valve 62 to the first nozzle 71, and from the first nozzle 71 towards impacted hard object, or ground surface 15, of the work tool 32.

The connector channel 58, in an exemplary embodiment, may further include a second branch 72. The second branch 72 extends from the first branch 70, and curves perpendicularly to the axis 30, through the second wall 39 connecting to a third branch 73, the third branch 73 being located internally of the third wall 40. In a further exemplary embodiment, depicted in FIG. 5, the second branch is circular, and extends through the first, second, third, and fourth walls 38, 39, 40, 41 of the front head 35, allowing water to flow from the first branch 70 to the third branch 73. The third branch 73 may extend from the proximal end 36 to the distal end 37 of the front head 35, and is internally channeled inside the third wall 40, allowing water to flow, and be delivered to, a second nozzle 74 of the one or more nozzles 66. The connector channel 58 can further serve to cool the front head 35 to between 200 and 300 degrees Celsius, as the water flowing through the connector channel will cool the front head 35 from the heat generated during operation.

The one or more nozzles 66, in an exemplary embodiment, are conical. The bottom end 68 of the front head 35 includes a threaded portion 76, and the one or more nozzles 66 are threaded (not shown), allowing the one or more nozzles 66 to be screwed into the front head 35. This allows for different sized and shaped nozzles to be screwed into the front head 35, depending on need and anticipated dust creation. Different nozzles can include different flow rates to control the rate of water displacement, as well as the area of the water displacement, towards the ground surface 15, or hard object, that is being struck by the work tool 32.

Figure 8:
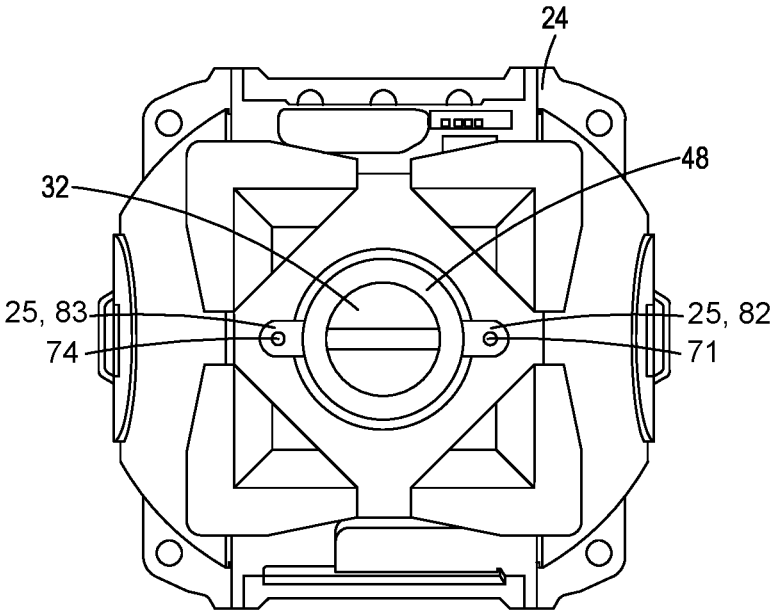
FIG. 8 is a bottom view of an exemplary wear plate of the demolition hammer of FIG. 2.

As further shown in FIG. 5, a bottom end 78 of the one or more nozzles 66 is between 2 and 6 centimeters above a top end 80 of the bottom wear plate 24. Other distances may be used depending on operation, but this distance allows the one or more nozzles 66 to spray water 81 (shown in FIG. 2) through their respected slots 25 (shown in FIG. 8) on the bottom wear plate 24. As best shown in FIG. 8, the bottom wear plate 24 includes a first slot 82 and a second slot 83 that correspond respectively to the first nozzle 71 and the second nozzle 74. The distance between the nozzles 66 and the bottom wear plate 24 may protect the nozzles from damage during operation of the demolition hammer 1, as well as protect the nozzles from getting clogged with debris or dust from the ground surface 15 or impacted hard object.

As shown in FIG. 6, the water hose 56 is routed within the power cell 26. Before being routed within the power cell 26, the water hose 56 is connected to a housing valve 85 located inside a side wall 86 of the housing 18. The housing valve 85 passes through the side wall 86 and allows of the water hose 56 to be routed within the power cell 26 before being connected to the connection valve 62. This allows water to flow from outside of the demolition hammer 1 to the connector channel 58, and finally out of the one or more nozzles 66. The water hose 56 is routed within the power cell 26 by routing the water house from the housing valve 85 through an area above the front head 35, defined by the first, second, third, and fourth walls 38, 39, 40, 41 of the front head 35.

Further exemplary embodiments, as shown in FIG. 1, may include a water source 88 located on the work machine 2. The water source may include any container capable of holding water. Water may be routed from the water source using an extension water hose 89 along the boom 11 and the arm 12 of the work machine 2 to the demolition hammer 1. The extension water hose 89 then connects to the housing valve 85 to supply water to the dust suppression system 54. In another exemplary embodiment, the water hose 56 extends from the water source 88, along the boom 11 and the arm 12, and through an aperture 90, or aperture 91 shown in FIG. 6, located on the side wall 86 of the housing before being routed within the power cell 26.

INDUSTRIAL APPLICABILITY

In general, the teachings of the present disclosure may find applicability in many industries including, but not limited to, demolition hammers. More specifically, the teachings of the present disclosure may find applicability in any industry using dust suppression systems for suppressing dust created during the operation of demolition hammers.

Figure 9:
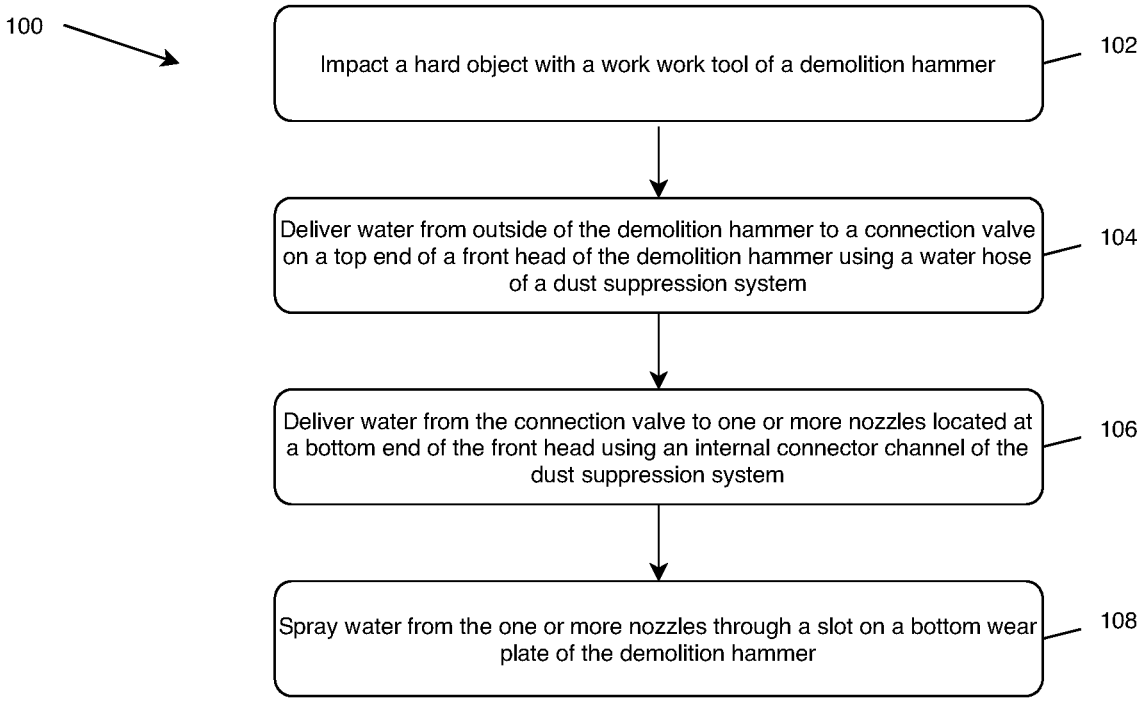
FIG. 9 is a flow chart of a series of steps that may be involved in the suppression of dust created during the operation of a demolition hammer, in accordance with aspects of the present disclosure.

Turning now to FIG. 9, with continued reference to FIGS. 1-8, a flowchart illustrating an example process 100 for suppressing dust created during a hammering operation is disclosed. At block 100, a hard object is impacted by a work tool 32 of a demolition hammer 1. During operation of the demolition hammer 1, high pressure fluid enters the hammer through the valve body 52 which is further pressurized inside the hydraulic circuit 34, or pneumatic systems of the hammer. This high-pressure fluid accelerates the piston 28 which hits the work tool 32. When the tool is in contact with the hard object, such as a rock boulder or ground surface 15, a shock wave is created, and impact energy is transferred onto the hard object. Due to this phenomenon the hard object breaks causing large amounts of dust.

As shown in blocks 102-108, the disclosed dust suppression system 54 for a demolition hammer 1 has a water hose 56 carrying water within the power cell 26 of the demolition hammer 1. In block 104, the water hose 56 delivers from outside of the demolition hammer 1 to a connection valve 62 on a top end 64 of a front head 35 of the demolition hammer 1. In block 104, the connection valve 62 delivers the water to a connector channel 58 of the dust suppression system 54 before the water flows out of one or more nozzles 66 located at the bottom end 68 of the front head 35. Finally, in block 108, the one or more nozzles 66 may spray water through a slot 25 of a bottom wear plate 24 of the demolition hammer towards the impact site of the work tool 32 and the hard object. Spraying water while the hammer is in action may suppress the dust. Further, routing the water hose 56 within the power cell 26 may protect the water hose 56 from wear, as the housing 18 of the demolition hammer is a wear part.

Further, need for multiple hoses may be eliminated by having the connector channel 58 and any ports or valves drilled in the front head 35. The bottom wear plate 24 might have slots 25 for the water to be sprayed through and to perform the task of dust suppression, with the bottom wear plate 24 protecting the one or more nozzles 66 from damage or debris by having the nozzles located above the bottom wear plate 24.

Although the disclosed embodiments have been described with reference to a demolition hammer assembly in which the work tool is driven by a hydraulically or pneumatically actuated piston, the disclosed embodiments are applicable to any tool assembly having a reciprocating work tool movable within a chamber by suitable drive structure and/or return structure.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A dust suppression system, comprising:

a water hose routed within a power cell of a demolition hammer; and a connector channel internal of one or more walls of a front head of the demolition hammer and having a first branch extending internally through a first wall of the one or more walls from a proximal end of the front head at which the water hose is connected to a distal end of the front head, the water hose being configured to deliver water from outside of the demolition hammer to a connection valve on the proximal end of the front head, and the first branch of the internal connector channel being configured to deliver the water from the connection valve to a first nozzle of one or more nozzles located at the distal end of the front head wherein:

the front head comprises four walls of the one or more walls and a center aperture, the center aperture supporting a work tool of the demolition hammer, the connector channel has a second branch that extends through a second wall of the one or more walls, the second branch configured to be curved and extends internally inside of the first wall and the second wall, the second branch is configured to deliver the water from the first branch to a third branch of the connector channel, the third branch extending internally through a third wall of the one or more walls from the second branch to the distal end of the front head, the third branch configured to deliver the water to a second nozzle of the one or more nozzles, and the second nozzle being located at the distal end of the front head, the second branch is circular, extending through the first wall, the second wall, the third wall, and a fourth wall of the one or more walls, the front head includes a threaded portion, and at least one of the one or more nozzles is threaded, allowing the at least one nozzle to be screwed into the front head and wherein the at least one nozzle is conical, in which the water hose is routed within the power cell by routing the water hose from the connection valve and through an area above the front head, defined by a first wall, a second wall, a third wall, and a fourth wall of the one or more walls, to the connection valve, and the connector channel is configured to cool the front head between 200 and 300 degrees Celsius when the water is flowing through the connector channel.

2. A dust suppression system, comprising:

a water hose routed within a power cell of a demolition hammer; and a connector channel internal of one or more walls of a front head of the demolition hammer and having a first branch extending internally through a first wall of the one or more walls from a proximal end of the front head at which the water hose is connected to a distal end of the front head, the water hose being configured to deliver water from outside of the demolition hammer to a connection valve on the proximal end of the front head, and the first branch of the internal connector channel being configured to deliver the water from the connection valve to a first nozzle of one or more nozzles located at the distal end of the front head, wherein the demolition hammer includes a housing having a bottom end proximate the distal end of the front head, wherein the dust suppression system comprises a bottom wear plate mounted to the bottom end of the housing and having a space between bottoms of the one or more nozzles and a top surface of the bottom wear plate, wherein the bottom wear plate has slots, the slots configured to allow the one or more nozzles to spray water through the slots and away from the demolition hammer.

* * * * *